US009322540B2

(12) United States Patent
Cheng

(10) Patent No.: US 9,322,540 B2
(45) Date of Patent: Apr. 26, 2016

(54) HEAT RADIATION DEVICE AND ILLUMINATING DEVICE HAVING SAID HEAT RADIATION DEVICE

(71) Applicant: OSRAM GmbH, Munich (DE)

(72) Inventor: YingJun Cheng, Shanghai (CN)

(73) Assignee: OSRAM GmbH, Munich (DE)

( * ) Notice: Subject to any disclaimer, the term of this patent is extended or adjusted under 35 U.S.C. 154(b) by 12 days.

(21) Appl. No.: 14/365,107

(22) PCT Filed: Nov. 20, 2012

(86) PCT No.: PCT/EP2012/073106

§ 371 (c)(1),
(2) Date: Jun. 13, 2014

(87) PCT Pub. No.: WO2013/087373

PCT Pub. Date: Jun. 20, 2013

(65) Prior Publication Data

US 2014/0313750 A1 Oct. 23, 2014

(30) Foreign Application Priority Data

Dec. 14, 2011 (CN) ..... 2011 1 0418688

(51) Int. Cl.

| | |
|---|---|
| ***F21V 29/00*** | (2015.01) |
| ***F21V 19/00*** | (2006.01) |
| ***F28F 21/08*** | (2006.01) |
| ***F21V 29/77*** | (2015.01) |
| ***F21V 29/87*** | (2015.01) |
| *F28F 3/02* | (2006.01) |
| *F28F 13/18* | (2006.01) |
| *F28F 21/06* | (2006.01) |
| *F21Y 101/02* | (2006.01) |
| *F28F 13/00* | (2006.01) |

(52) U.S. Cl.

CPC ..... *F21V 29/004* (2013.01); *F21V 19/005* (2013.01); *F21V 29/777* (2015.01); *F21V 29/87* (2015.01); *F28F 21/06* (2013.01); *F28F 21/089* (2013.01); *F21Y 2101/02* (2013.01); *F28F 3/02* (2013.01); *F28F 13/18* (2013.01); *F28F 21/067* (2013.01); *F28F 2013/006* (2013.01)

(58) Field of Classification Search

CPC ..... F21V 29/004; F21V 29/777; F21V 29/87; F28F 21/089; F28F 21/06

See application file for complete search history.

(56) References Cited

U.S. PATENT DOCUMENTS

| | | | |
|---|---|---|---|
| 7,044,212 | B1 | 5/2006 | Hofmann |
| 2003/0183379 | A1 | 10/2003 | Krassowski et al. |

(Continued)

FOREIGN PATENT DOCUMENTS

| | | | |
|---|---|---|---|
| KR | 20030046778 | A | 6/2003 |
| WO | 2009115512 | A1 | 9/2009 |
| WO | 2010136985 | A1 | 12/2010 |

OTHER PUBLICATIONS

English abstract of KR 20030046778 A of Jun. 18, 2003.

(Continued)

*Primary Examiner* — Anne Hines

(74) *Attorney, Agent, or Firm* — Viering, Jentschura & Partner mbB

(57) ABSTRACT

Various embodiments relate to a heat radiation device for a heat source. The heat radiation device includes a body and a coating layer, wherein the body has a first section and at least one second section projecting from the first section, the first section has a mounting surface for mounting and thermally contacting with the heat source and the coating layer is applied on the surface other than the mounting surface of the first section and a surface of the at least one second section, wherein the coating layer has higher thermal dissipation performance than the body. In addition, various embodiments further relate to an illuminating device having the above type of heat radiation device.

15 Claims, 2 Drawing Sheets

(56) References Cited

U.S. PATENT DOCUMENTS

| | | | |
|---|---|---|---|
| 2007/0018312 | A1 | 1/2007 | Jo |
| 2007/0053168 | A1 | 3/2007 | Sayir et al. |
| 2007/0272400 | A1 | 11/2007 | Abul-Haj et al. |
| 2010/0302790 | A1 | 12/2010 | Yen |
| 2011/0095690 | A1 | 4/2011 | Sagal |
| 2011/0170302 | A1 | 7/2011 | Breidenassel et al. |
| 2011/0242817 | A1 | 10/2011 | Chowdhury et al. |

OTHER PUBLICATIONS

International Search Report issued in the corresponding PCT application No. PCT/EP2012/073106, dated Feb. 19, 2013.

HEAT RADIATION DEVICE AND ILLUMINATING DEVICE HAVING SAID HEAT RADIATION DEVICE

RELATED APPLICATIONS

The present application is a national stage entry according to 35 U.S.C. §371 of PCT application No.: PCT/EP2012/073106 filed on Nov. 20, 2012, which claims priority from Chinese application No.: 201110418688.1 filed on Dec. 14, 2011, and is incorporated herein by reference in its entirety.

TECHNICAL FIELD

Various embodiments relate to a heat radiation device. In addition, various embodiments further relate to an illuminating device having said heat radiation device.

BACKGROUND

LED retrofit lamps such as MR16, PAR38, Class A and down light are increasingly finding their way of replacing traditional illuminating devices such as incandescent and fluorescent lamps because such LED retrofit lamps are more energy-efficient and have smaller sizes and longer lifetime. With the technological development, LED package itself can achieve higher efficiency such as 160 lm/W for cold white and 100 lm/W for warm white and have a long lifetime up to 50,000 hours, but when LEDs are integrated into a retrofit lamp together with an LED driver, a thermal management device and an optical component, the efficiency and life of the retrofit lamp are highly dependent on how to design the driver, heat radiation device and optical component. In an LED, the consumed electrical power is converted to heat rather than light. According to the U.S. Department of Energy, about 75% to 85% of energy used to drive LEDs is converted to heat, and the heat must be conducted from the LED chip to the underlying printed circuit board and heat radiation device. If the heat is not removed in time, excess heat can not only reduce an LED's light output and produces a color shift in the short term, but also shorten the lifetime of the LED in the long term.

The primary path of heat transfer in an LED is usually from the junction to the outside of the package. The package level thermal management is provided for LED device manufacturing to minimize the thermal resistance from the junction to the outside of the package. The essence of thermal management design of a LED lamp is transferring the heat efficiently from the LED package to the ambient surroundings. First of all, a secure and thermally efficient bond must be provided between the package slug and the circuit board. The thermal connection typically runs through a metal core PCB. Heat is typically conducted through this PCB to an external heat radiation device. The Heat radiation device provides a path for transferring heat from the LED package to the ambient surroundings in three ways: conduction (heat is transferred from one solid to another), convection (heat is transferred from a solid to a moving fluid, and for most LED applications, the fluid will be air), and radiation (heat is transferred between two objects with different surface temperatures through electromagnetic waves). The heat conduction through the heat radiation device itself is associated with the following factors: thermal conductivity of heat radiation device materials (k), conduction area (A) and length (L) (Fourier law: $Q=k\times A\times\Delta T/L$). For a certain amount of heat (Q) passing through the heat radiation device, the higher the thermal conductivity or the larger the conduction area or the smaller the conduction length is, the smaller the temperature rise ($\Delta T$) within the heat radiation device is. The heat convection from the heat radiation device to the ambient surroundings is associated with the following factors: surface area (A) and local convection heat transfer coefficient (h) (Newton law: $Q=h\times A\times\Delta T$), which depends on the size and geometry shape of the heat radiation device. The heat radiation from the heat radiation device surface to the ambient surroundings is associated with the following factors: surface area (A) and surface emissivity ($\epsilon$) (Stefan-Boltzmann law: $Q=\epsilon\times A\times\sigma\times\Delta T^4$, where $\sigma$ is the Stefan-Boltzmann constant). Therefore, the overall heat dissipation capability of the heat radiation device relies on the heat radiation device materials, the heat radiation device size and geometry shape and the surface treatment of the heat radiation device surface. For the heat radiation device materials, aluminum is a widely used heat radiation device material nowadays because of its high thermal conductivity and relatively low cost, while ceramic and thermally conductive plastic are also used as the heat radiation device material in some applications and designs.

For most of the current heat radiation devices for LED retrofit lamps, they are usually made of aluminum, and in some patents, a combination of high thermally conductive materials and thermally conductive plastic is used to manufacture the heat radiation device, mainly for the purpose of reducing weight and complex shape manufacturing.

Patent Document WO 2009/115512 A1 discloses a heat radiation device and a process for producing the heat radiation device, wherein said heat radiation device comprises a plastic body made of a thermally conductive plastic material comprising expanded graphite in an amount of at least 20 wt. %, relative to the total weight of the thermally conductive plastic material and has an in-plane thermal conductivity of at least 7.5 W/m/K. The heat radiation device can be produced by injection-moulding the thermally conductive plastic material, optionally followed by applying a coating layer. The heat radiation device and the heat source are assembled together by being thermally connected to each other.

Patent Document US 2003/0183379 A1 discloses a composite heat radiation device utilizing a high thermally conductive base and low thermally conductive fins. The base is preferably made of an anisotropic graphite material, and the fins are preferably made of a thermally conductive plastic material. In the case of a low profile heat radiation device, the fin height is no greater than 15 mm. This composite construction provides superior cooling effect yet lighter weight as compared to a conventional all-aluminum heat radiation device of the same dimension.

Patent Document US 2007/0272400 A1 discloses a heat radiation device having tapered geometry that improves passive cooling efficiency. The tapered geometry between heat radiation device heat dissipation elements decreases resistance to ratification of passively flowing cooling gas upon heating. Thus, the tapered heat radiation device elements results in high velocity of gas flow and increased cooling efficiency of the heat radiation device. Optionally, the heat radiation device is made from a thermally conductive polymer allowing the heat radiation device to be created in complex shapes using injection moulding.

Ceramic may also be used a thermally conductive material. Patent Document WO 2010/136985A1 discloses an illumination device comprising a light source arranged to generate light, and a carrier arranged to support the light source. Further, the carrier is arranged in thermal contact with the envelope and both the envelope and the carrier are made of a ceramic material. The disclosure is advantageous in that it provides an illumination device providing an effective heat transfer.

However, the drawback of the above disclosure lie in, when aluminum is used as a material for manufacturing the heat radiation device, the heat radiation device has a relatively large weight, and the shape design and manufacturing thereof are confined. The thermally conductive plastic material has a thermal conduction performance similar to aluminum in some applications and designs, and offers the benefits of lower weight, more design freedom and easier manufacturing, but the material cost is relatively high. Ceramic has relative good thermal conductivity but it is heavy and brittle.

SUMMARY

In order to solve the problem present in the related art, various embodiments provide a heat radiation device, which has the advantages of low cost, small weight, and favorable design freedom while providing good thermal dissipation performance. In addition, various embodiments further relate to an illuminating device having the above type of heat radiation device.

Various embodiments provide a heat radiation device. Said heat radiation device includes a body and a coating layer, wherein the body has a first section and at least one second section projecting from the first section, the first section has a mounting surface for mounting and thermally contacting with the heat source and the coating layer is applied on a surface other than the mounting surface of the first section and a surface of the at least one second section, wherein the coating layer has higher thermal dissipation performance than the body. The heat radiation device according to the present disclosure is a composite heat radiation device. Since the thermal dissipation performance of the body is relatively poor, viz. the thermal conductivity is relatively low, a larger selection range is available for selecting a material for manufacturing the body. The body may be made of a low cost, easy processing and manufacturing material. And the coating layer may have a relatively high thermal conductivity, which ensures that the heat radiation device further has a good thermal dissipation performance and a complex configuration while having a relatively low manufacturing cost.

Preferably, the coating layer is made of coating having a thermal conductivity greater than 5 W/m/K.

Further preferably, the coating is mixed with one selected from a group consisting of nickel, silver, graphite, nanocarbon, $TiO_2$, $Al_2O_3$ and boron nitride, spinel. These materials mixed into the coating layer may improve the thermal conductivity of the coating layer and further improve the thermal dissipation performance of the whole heat radiation device. In the design solution of the present disclosure, the coating for manufacturing the coating layer may be thermally conductive coating with an electrical insulation property, e.g., inorganic coating (using water soluble silicates, silica sols, silicone, inorganic polymers, etc. as a base material) added with boron nitride, spinel, $TiO_2$, $Al_2O_3$, and the like and organic coating (coating of an organic solvent or an aqueous (water-soluble type or water-emulsion type) organic solvent). Optically, the coating for manufacturing the coating layer may be thermally conductive coating without the electrical insulation property, e.g., inorganic coating added with silver, nickel, carbon, etc. and organic coating.

Advantageously, the coating layer has a thickness of 200 to 500 micron, which ensures that the heat can be efficiently transferred outward from the body.

According to various embodiments, the body is made of low thermally conductive plastic with a thermal conductivity lower than 1 W/m/K. Preferably, the low thermally conductive plastic is a PBT, TOM, PA, or ABS material having a thermal conductivity between 0.1 to 0.3 W/m/K. Further preferably, the first section and the second section are moulded in one piece by injection moulding. The above mentioned material, generally used to manufacture a housing of a lamp, has a lower cost as compared to the conventional aluminum and ceramic materials. A complex configuration may be created by injection moulding by using above mentioned material.

According to various embodiments, the at least one second section is at least one fin extending from the first section. This fin can increase the thermal dissipation area of the whole heat radiation device, thereby improving the thermal dissipation performance of the whole heat radiation device.

Further preferably, at least one thermal via is opened in the first section and the at least one second section. The thermal vias in the first section extend traverse to extension direction of the first section and the thermal vias in the second section extend traverse to the extension direction of the second section The thermal via improves the thermal dissipation performance of the heat radiation device and shortens a heat transfer path between the coating layer and the body. Further preferably, the thermal via is filled by the same material as that of the coating layer, which further improves the thermal dissipation performance of the heat radiation device.

Various embodiments further provide one LED illuminating device having the above type of heat radiation device. Said LED illuminating device has a low cost and a better thermal dissipation performance.

Preferably, the heat source includes a circuit board and an LED chip provided on the circuit board.

Further preferably, the circuit board is configured as a non-electrically isolated metal core printed circuit board, or an electrically isolated ceramic printed circuit board. In the design solution of the present disclosure, the circuit board and the body are moulded together or the circuit board is attached to the mounting surface of the first section of the body with a thermal interface material. Herein, the circuit board is used as a heat spreader, therefore, the heat from the heat source, viz. the LED chip, may be uniformly distributed to the main body of the heat radiation device via the circuit board serving as the heat spreader and further dissipated into ambient surroundings, which can improve significantly the thermal performance of the heat radiation device and prolong the lifetime of the LED illuminating device.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
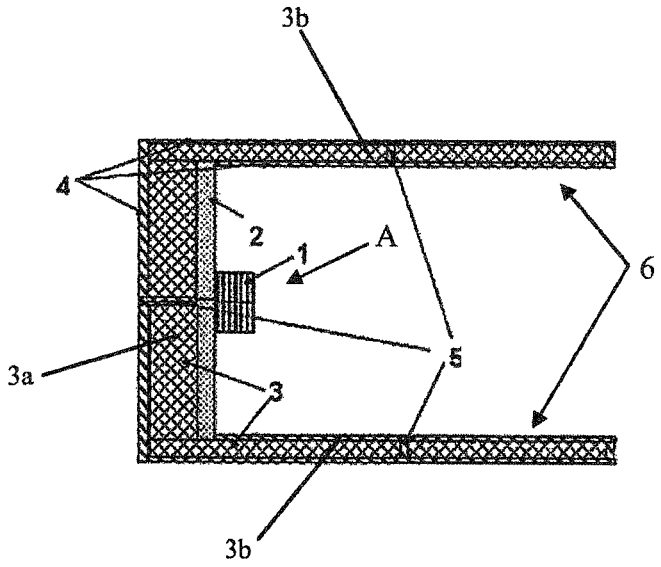
FIG. 1 is a view illustrating a first embodiment of a heat radiation device according to the present disclosure.

FIG. 1 is a view illustrating a first embodiment of a heat radiation device according to the present disclosure. As may be seen from FIG. 1, said heat radiation device comprises a body 3 and a coating layer 4. In this embodiment, the body 3 is made of a low thermally conductive material such as a PBT, TOM, PA, or ABS material having a thermal conductivity between 0.1 to 0.3 W/m/K and the coating layer 4 is made of coating having a thermal conductivity greater than 5 W/m/K. The coating is mixed with one selected from a group consisting of nickel, silver, graphite, nano-carbon, $TiO_2$, $Al_2O_3$ and boron nitride, spinel and has a thickness of 200 to 500 micron. In the design solution of the present disclosure, the coating for manufacturing the coating layer may be thermally conductive coating with an electrical insulation property, e.g., inorganic coating (using water soluble silicates, silicasols, silicone, inorganic polymers, etc. as a base material) added with boron nitride, spinel, $TiO_2$, $Al_2O_3$, and the like and organic coating (coating of an organic solvent or an aqueous (water-soluble type or water-emulsion type) organic solvent). Optically, the coating for manufacturing the coating layer may be thermally conductive coating without the electrical insulation property, e.g., inorganic coating added with silver, nickel, carbon, etc. and organic coating.

As may be further seen from said figure, the body 3 has a first section 3*a* and at least one second section 3*b* projecting from the first section 3*a*, wherein the first section 3*a* has a mounting surface for mounting and thermally contacting with the heat source A and the coating layer 4 is applied on a surface other than the mounting surface of the first section 3*a* and a surface of the at least one second section 3*b*. According to the present disclosure, the first section 3*a* and the second section 3*b* are moulded in one piece by injection moulding. In addition, at least one thermal via 5 is opened in the first section 3*a* and the at least one second section 3*b*, and the thermal via 5 is filled by the same material as that forming the coating layer 4. In addition, the thermal vias 5 in the first section 3*a* extend traverse to extension direction of the first section 3*a* and the thermal vias 5 in the second section 3*b* extend traverse to the extension direction of the second section 3*b*. Furthermore, FIG. 1 further shows an LED light source as the heat source A. The heat source A comprises a circuit board 2 and an LED chip 1 provided on the circuit board 2. In the design solution of the present disclosure, the circuit board 2 is designed as a non-electrically isolated metal core printed circuit board, or an electrically isolated ceramic printed circuit board and serves as a heat spreader.

In this embodiment, the body 3 has two second sections 3*b* forming two fins 6. These two fins 6 are mounted together with the heat source A at the same side of the body 3 and formed symmetrically at two sides of the heat source A.

Figure 2:
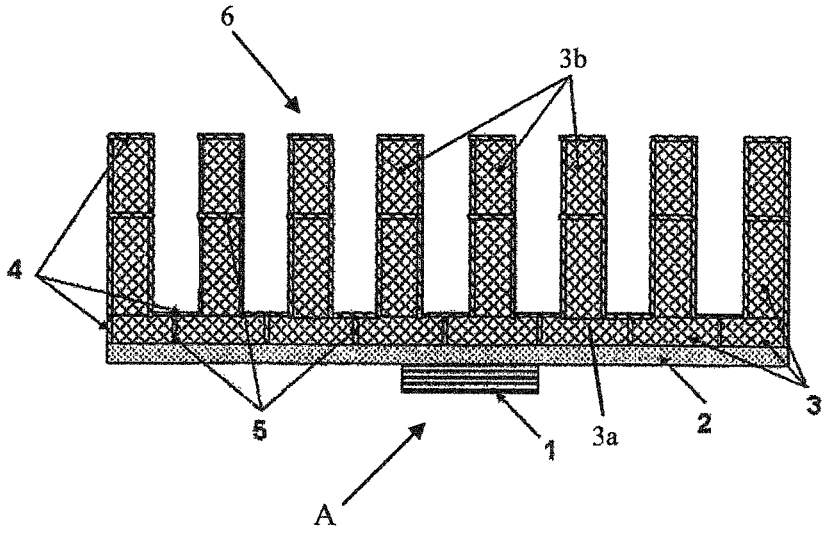
FIG. 2 is a view illustrating a second embodiment of a heat radiation device according to the present disclosure.

FIG. 2 is a view illustrating a second embodiment of a heat radiation device according to the present disclosure, which differs from the first embodiment as shown in FIG. 1 merely in that the body 3 has a plurality of second sections 3*b* formed as fins 6. Said figure shows eight fins 6, and these fins 6 and the heat source A are formed at two sides of the first sections 3*a*, respectively.

In the design solution of the present disclosure, a larger thermal dissipation area needs to be provided for obtaining good thermal dissipation effect, and the relative positions between the fins and the shape of the fin may be differently adjusted as required by thermal dissipation. The number and the shape of the fins as shown in said figure are merely exemplary and shall not limit the design solution of the present disclosure.

Figure 3:
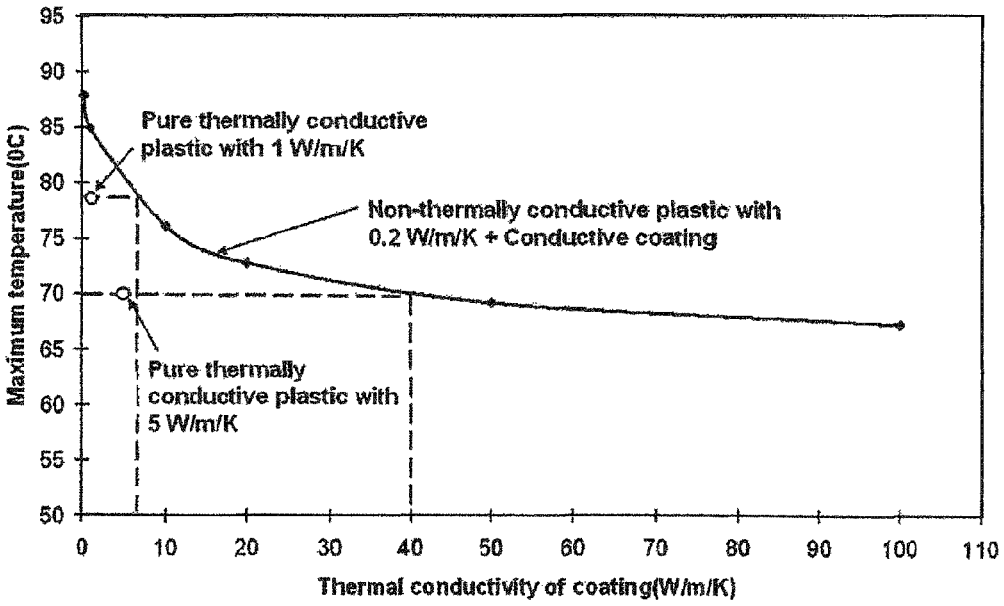
FIG. 3 is a graph of thermal dissipation performance in the case where a coating layer of a heat radiation device according to the present disclosure has different thermal conductivities.

FIG. 3 is a graph of thermal dissipation performance computed according to computational fluid dynamics and thermal simulation in the case where a coating layer 4 of a heat radiation device according to the present disclosure has different thermal conductivities, wherein it is assumed that the heat source A generates two-watt heat, and the body 3 is made of the PBT material and has a thermal conductivity of 0.2 W/m/K. The coating layer 4 has a thickness of 200 micron. The circuit board 2 serving as a heat spreader is designed as a non-electrically isolated metal core printed circuit board, or an electrically isolated ceramic printed circuit board and has a thermal conductivity of 30 W/m/K. As may be seen from FIG. 3, in the case of using different coating layers, the thermal dissipation performance of the heat radiation device according to the present disclosure is notably changed. If the thermal conductivity of the coating layer 4 is 7 W/m/K, the thermal dissipation performance of the heat radiation device according to the present disclosure is equivalent to that of the heat radiation device made of pure thermally conductive plastic with a thermal conductivity of 5 W/m/K. Thus, merely improving the thermal conductivity of the coating layer 4 may significantly improve the thermal dissipation performance of the heat radiation device.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

1 LED chip
2 circuit board
3 body
3*a* first section
3*b* second section
4 coating layer
5 thermal via
6 fin
A heat source

The invention claimed is:

1. A heat radiation device for a heat source, comprising a body and a coating layer, wherein the body has a first section and at least one second section projecting from the first section, the first section has a mounting surface for mounting and thermally contacting with the heat source and the coating layer is applied on a surface other than the mounting surface of the first section and a surface of the at least one second section, wherein the coating layer has higher thermal dissipation performance than the body, wherein at least one thermal via is opened in the first section and the at least one second section.

2. The heat radiation device according to claim 1, wherein the coating layer is made of coating having a thermal conductivity greater than 5 W/m/K.

3. The heat radiation device according to claim 2, wherein the coating is mixed with one component selected from a group consisting of nickel, silver, graphite, nano-carbon, $TiO_2$, $Al_2O_3$, boron nitride, and spinel.

4. The heat radiation device according to claim 2, wherein the coating layer has a thickness of 200 to 500 micron.

5. The heat radiation device according to claim 1, wherein the body is made of low thermally conductive plastic with a thermal conductivity lower than 1 W/m/K.

6. The heat radiation device according to claim 5, wherein the first section and the second section are moulded in one piece by injection moulding.

7. The heat radiation device according to claim 6, wherein the low thermally conductive plastic is a polybutylene terephthalate, poly oxymethylene, polyamide, or acrylonitrile butadiene styrene material.

8. The heat radiation device according to claim 1, wherein the at least one second section is at least one fin projecting from the first section.

9. The heat radiation device according to claim 1, wherein the thermal vias in the first section extend traverse to extension direction of the first section and the thermal vias in the second section extend traverse to the extension direction of the second section.

10. The heat radiation device according to claim 9, wherein the thermal via is filled by the same material as that of the coating layer.

11. An illuminating device, having a heat radiation device for a heat source, the heat radiation device comprising a body and a coating layer, wherein the body has a first section and at least one second section projecting from the first section, the first section has a mounting surface for mounting and thermally contacting with the heat source and the coating layer is applied on a surface other than the mounting surface of the first section and a surface of the at least one second section, wherein the coating layer has higher thermal dissipation performance than the body, wherein at least one thermal via is opened in the first section and the at least one second section.

12. The illuminating device according to claim 11, wherein the heat source comprises a circuit board and an LED chip provided on the circuit board.

13. The illuminating device according to claim 12, wherein the circuit board is configured as a non-electrically isolated metal core printed circuit board, or an electrically isolated ceramic printed circuit board.

14. The illuminating device according to claim 11, wherein a circuit board and the body are moulded together.

15. The illuminating device according to claim 11, wherein a circuit board is attached to the mounting surface of the first section of the body with a thermal interface material.

* * * * *